US005927310A

United States Patent [19]

Lin

[11] Patent Number: 5,927,310

[45] Date of Patent: Jul. 27, 1999

[54] DOUBLE SUNSHADE

[76] Inventor: Chen-Hsiung Lin, No. 174, Pi Tan Village, Lu Tsao Hsiang, Chia Yi Hsien, Taiwan

[21] Appl. No.: 09/110,456

[22] Filed: Jul. 7, 1998

[51] Int. Cl.[6] ..... A45B 11/00

[52] U.S. Cl. ..... 135/20.1; 135/27; 135/29; 135/33.2

[58] Field of Search ..... 135/98, 99, 16, 135/20.1, 20.3, 29, 31, 32, 33.2, 27, 28

[56] References Cited

U.S. PATENT DOCUMENTS

| | | | |
|---|---|---|---|
| 990,632 | 4/1911 | Burton . | |
| 1,934,569 | 11/1933 | Stuttgen . | |
| 2,743,734 | 5/1956 | Terrell et al. . | |
| 3,160,165 | 12/1964 | Greenbie . | |
| 4,144,900 | 3/1979 | Kinski | 135/20.1 |
| 5,002,080 | 3/1991 | Ma | 135/20.1 |
| 5,263,505 | 11/1993 | Yeom | 135/28 X |
| 5,437,297 | 8/1995 | Crisman et al. | 135/20.1 |

*Primary Examiner*—Lanna Mai
*Attorney, Agent, or Firm*—Rosenberg, Klein & Bilker

[57] ABSTRACT

A double sunshade includes a main shank, a left subordinate sunshade, a right subordinate sunshade and a canopy. The main shank has a main cap atop and a main runner fitted movably around the main shank, main spreaders pivotally connected to the main runner, and main ribs pviotally connected to the main inside cap. The main ribs cross with the main spreaders at pivotal points and then extends further outward to be pivotally connected to subordinate inside caps and subordinate runners of the left and the right subordinate sunshades. Then the subordinate runners of the left and the right subordinate sunshades may be moved up and down for spreading or collapsing the subordinate spreaders and the subordinate ribs when the main runner is moved up and down, with a canopy spread or collapsed, too. And the canopy has a zipper or a Velcro band sewn at its peripheral edge for connecting a double sunshade to another for enlarging the dimensions for shading.

5 Claims, 8 Drawing Sheets

DOUBLE SUNSHADE

BACKGROUND OF THE INVENTION

This invention relates to a double sunshade, particularly to one having two sunshades combined together with a main shank to make a large sunshade with a broad canopy for shading.

So far sunshades are widely used in many places, such as leisure amusement parks, temporary industrial or commercial promotional exhibitions, etc. for shading bright sunlight to supply comfortable space. However, a single sunshade has a limited dimensions for shading, and many separate sunshades have to be spread out one by one if a large area needs shading from the sunlight.

SUMMARY OF THE INVENTION

This invention has bee devised to offer a double sunshade, which has a main shank, a main inside cap, a main runner for respectively pivotally connecting main ribs and spreaders for combining a left subordinate sunshade and a right subordinate sunshade so that the left and the right subordinate sunshades may be spread out or collapsed at the same time with the main ribs and main spreaders.

Another object of the invention is to offer a double sunshade having its canopy provided with a periphery sewn with a zipper or a Velcro band for connecting a double sunshade to another one to increase dimensions for shading.

BRIEF DESCRIPTION OF DRAWINGS

This invention will be better understood by referring to the accompanying drawings, wherein.

DETAILED DESCRIPTION OF THE PREFERRED EMBODIMENTS

Figure 1:
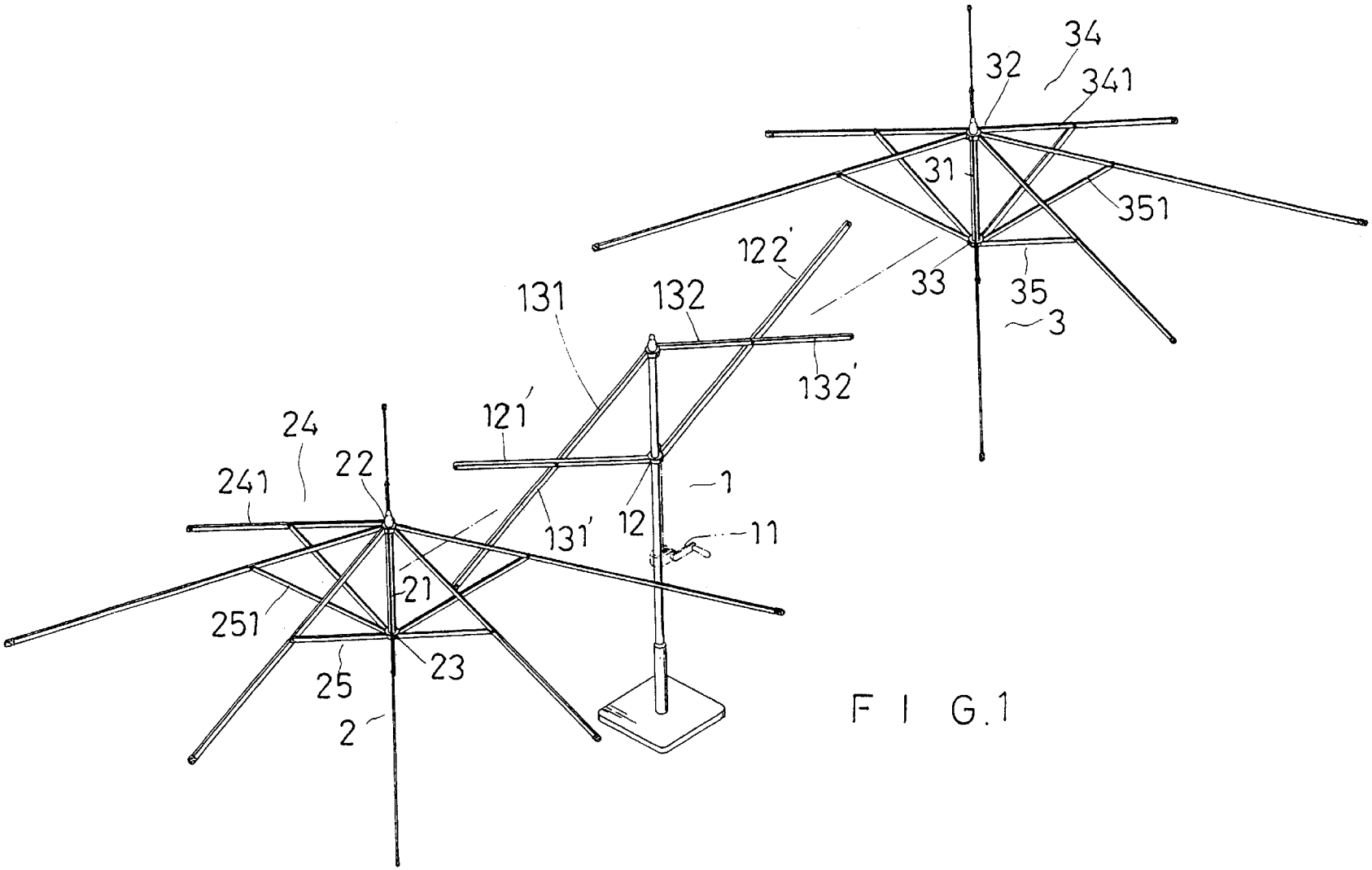
FIG. 1 is an exploded perspective view of a double sunshade of the present invention.
Figure 3:
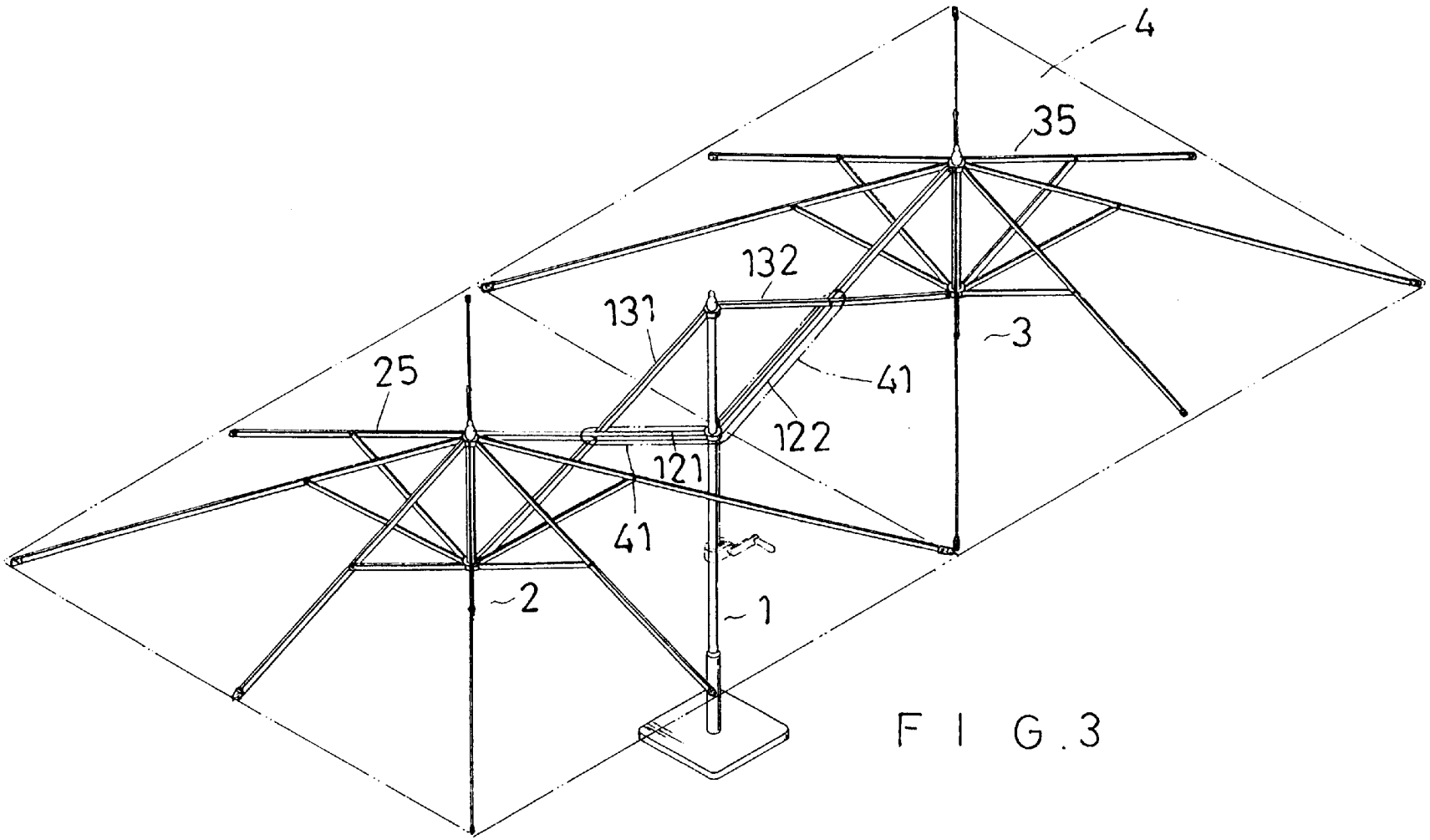
FIG. 3 is a perspective view of the double sunshade of the present invention.

A first embodiment of a double sunshade of the present invention, as shown in FIGS. 1 and 3, includes a main shank 1, a left subordinate sunshade 2, a right subordinate sunshade 3, and a canopy 4 as main components combined together.

Figure 2:
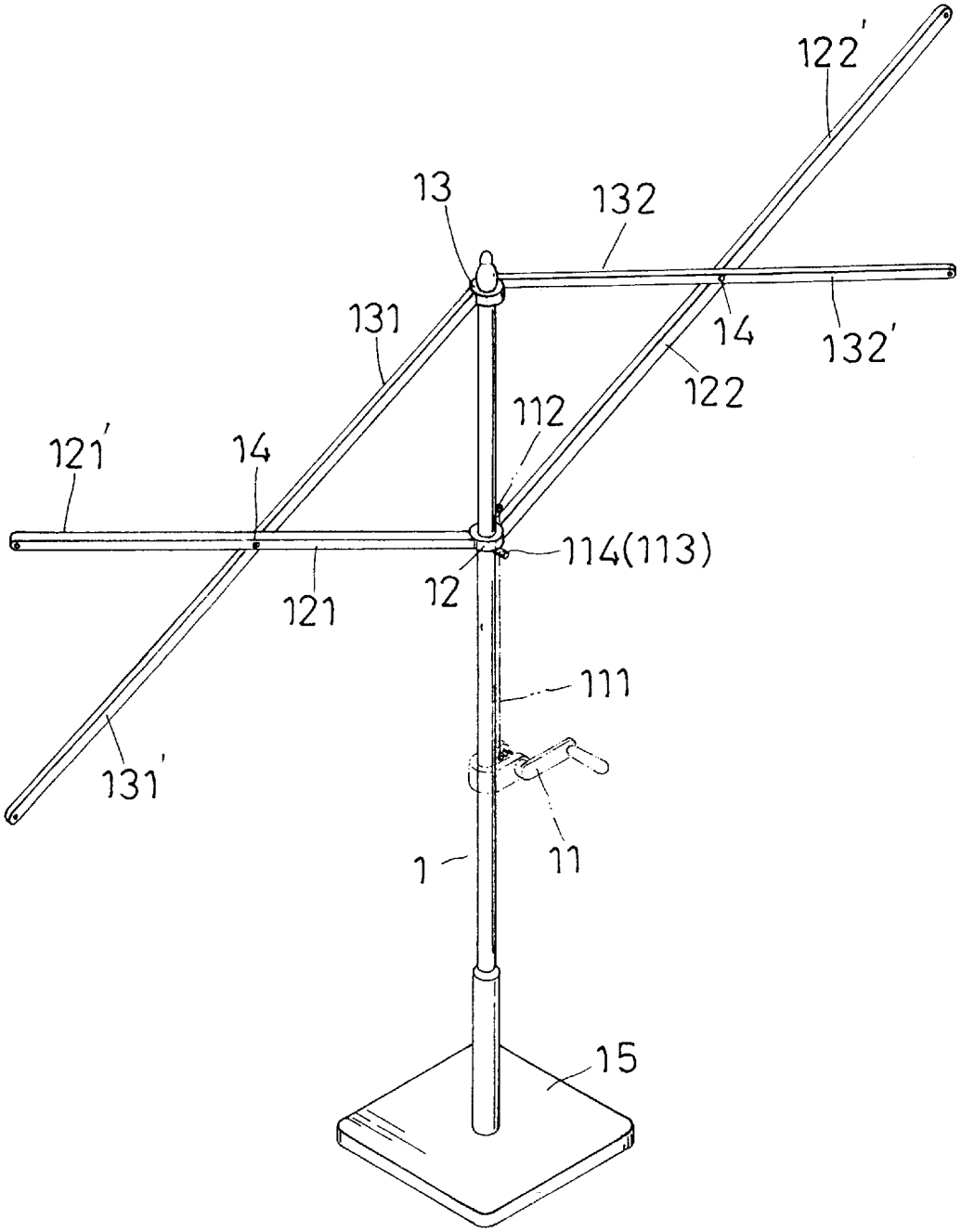
FIG. 2 is a perspective view of a main shank of a double sunshade of the present invention.

The main shank 1, as shown in FIG. 2, is made of a rod with a proper diameter, having a winder 11 fixed on a lower porion, a string 111 wound around the winder 11 and fixed on a ring 112 attached on a main runner 12 fitted movably around the main shank 1, and a tab 114 fitted in a hole 113 in an upper portion of the main shank 1. Further, an inside cap 13 is fixed firmly atop the main shank 1, and main rib

131, 132 are respectively connected pivotally to an inside cap 13 to extend to two opposite sides. Main spreaders 121, 122 are provided respectively to be connected to the main runner 12 to extend in two opposite sides. Then the spreaders 121, 122 and the ribs main ribs 131, 132 cross each other respectively at a pivotal point 14. Then subordinate ribs 121', 122' respectively extend from the pivotal points 14, forming a subordinate rib of the left and the right subordinate sunshades 2, 3. Other spreaders 131', 132' extends respectively from the pivotal points 14 to form a subordinate spreader of the left and the right subordinate sunshades 2, 3. Further, a base 15 is provided to support the main shank 1 to stand up securely on the ground.

The left subordinate sunshade 2 and the right subordinate sunshade 3 have the same structure as shown in FIG. 1, respectively including a subordinate shank 21, 31. a subordinate inside cap 22, 32 fixed firmly atop the left and the right subordinate sunshades, a subordinate runner 23, 33 respectively fitted around the subordinate shank 21, 31. Then to the subordinate inside caps 22, 32 and the subordinate runners 23, 33 are pivotally connected outer ends of the subordinate ribs 121', 122' and the subordinate spreaders 131', 132' so that when the main runner 12 of the main shank 1 moves to slide up and down the main shank 1, the subordinate runners 23, 33 are also moved to slide up and down the subordinate shanks 21, 31 by means of the interrelated pivotal connection.

Around the subordinate inside caps 22, 32 are connected a plurality of subordinate ribs 241, 341, forming rib skeletons 24, 34. And at the same time, each rib 241, 341 is connected pivotally to a spreader 251, 351 of a proper length, and an outer end of each spreader 251, 351 is pivotally connected to the subordinate runner 23, 33 to form a spreader skeleton 25, 35.

Figure 6:
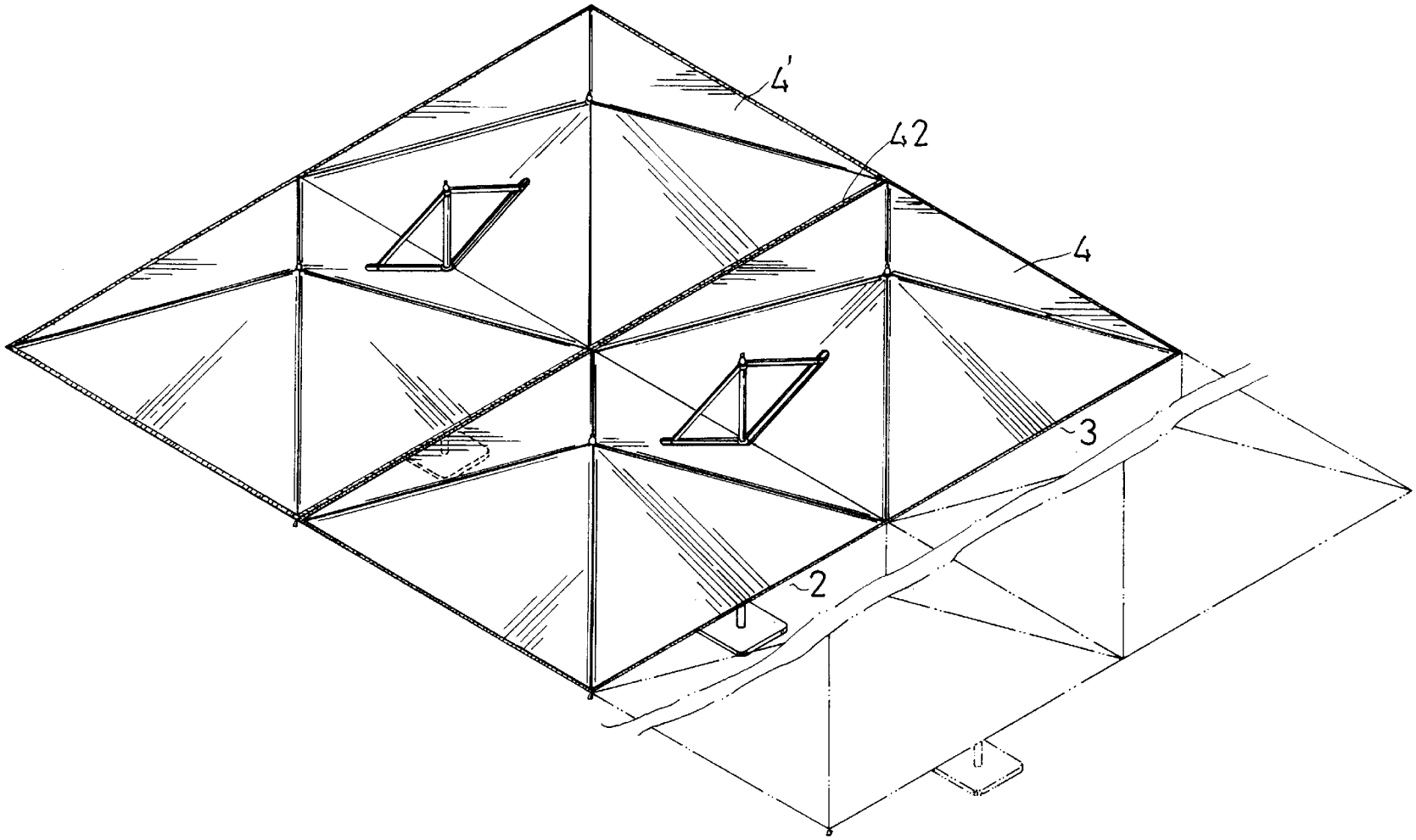
FIG. 6 is a perspective view of two of the double sunshades connected together of the present invention.

The canopy 4, as shown in FIG. 3, is preset shaped, covering and attached on the spreader skeletons 25, 35 of the left and the right subordinate sunshades 2, 3 and the main spreaders 121, 122. The canopy 4 further has an elongate opening 41 of a proper length in the center portion for the upper portion of the main shank 1 and the main ribs 131, 132 to extend through upward. Further, a zipper or a Velcro band 42 is sewn around the peripheral edge of the canopy 4 so as to connect to the canopy 4' of another double parasol, as shown in FIG. 6.

Figure 4:
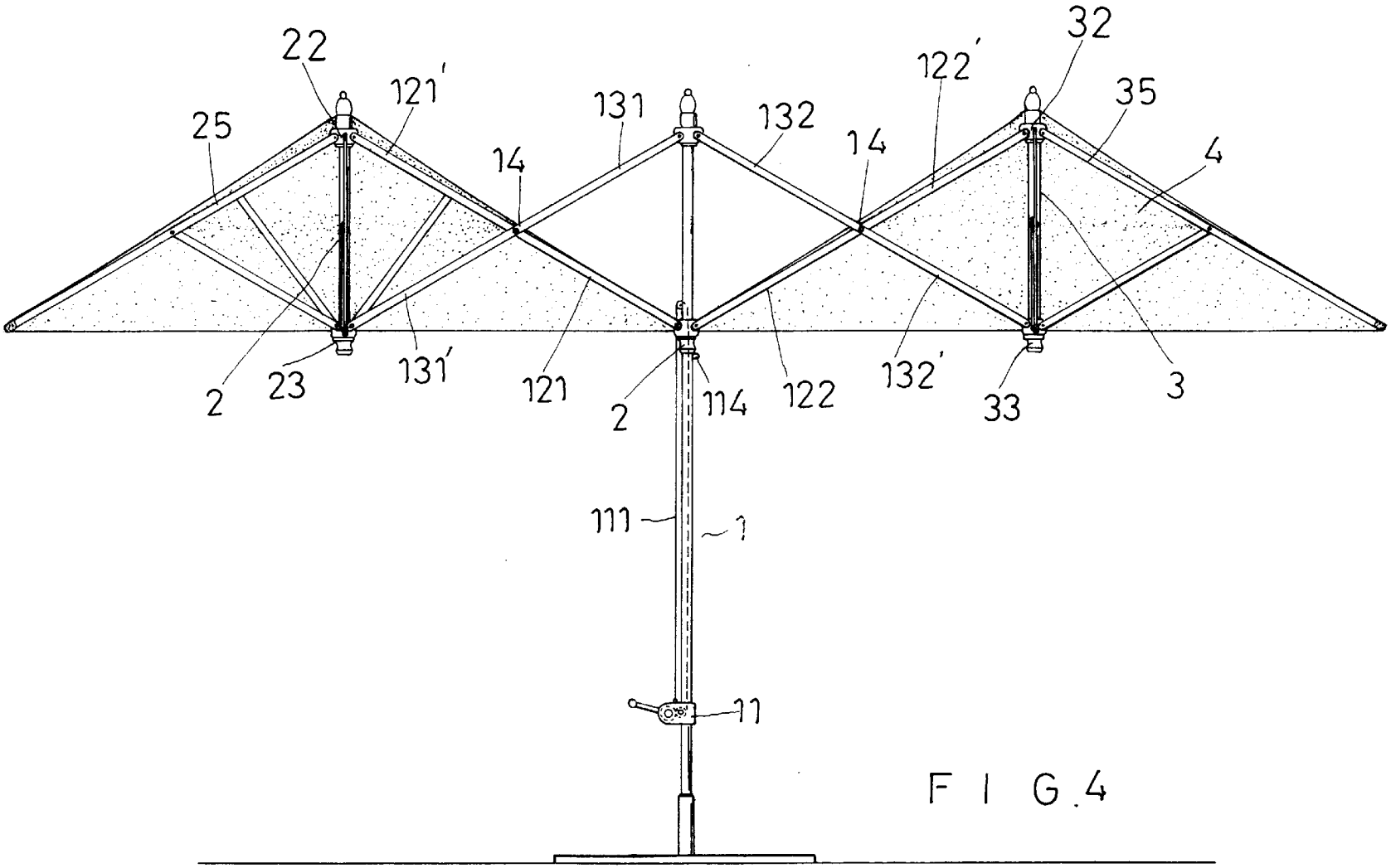
FIG. 4 is a cross-sectional view of the double sunshade of the present invention.
Figure 5:
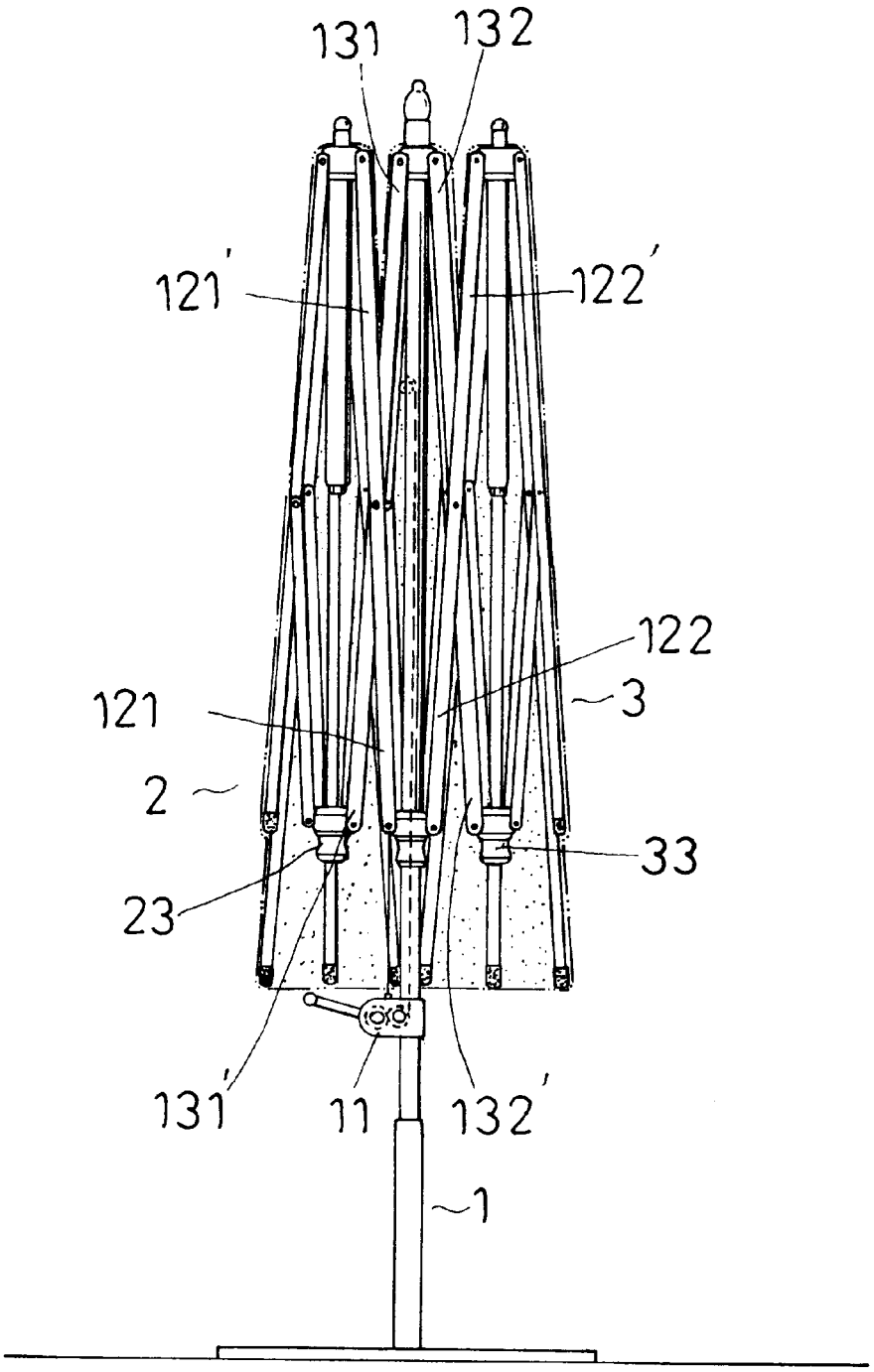
FIG. 5 is a side view of the double sunshade in a collapsed condition of the present invention.

When the double sunshade in a collapsed condition shown in FIG. 5 is to be spread out into a spread condition shown in FIG. 3, the winder 11 on the main shank 1 is wound to let the string 111 pull the main runner 12 to move upward to a highest point, with the main spreaders 121, 122 moved together with the main ribs 131, 132, and with the subordinate ribs 121', 122' moved together with the subordinate spreaders 131', 132' by means of the pivotal points 14. Then the subordinate runners 23, 33 of the left and the right subordinate sunshades 2, 3 are moved up to a highest point, spreading the rib skeletons 25, 35 and subsequently the canopy 4 out completely. Then the tab 114 in the hole 133 may support the main runner 12 temporarily, preventing the main runner 12 from sliding down, as shown in FIG. 4, with the left and the right sunshades 2, 3 also spread out for use.

If the double sunshade in the spread condition is to be collapsed into the collapsed condition shown in FIG. 5, the tab 114 is taken out of the hole 113, and the winder 11 is wound in a reverse direction, releasing the string 111 to let the main runner 12 move down to a lowest point, with the main spreaders 121, 122 bending inward, and with the subordinate spreaders 121', 122' and the subordinate ribs 131', 132' of the left and the right sunshades 2, 3 bending inward at the same time. Thus the left and the right sunshades 2, 3 are collapsed synchronously when the main runner 12 of the main shank 1 slides down to the lowest point, as shown in FIG. 5.

In addition, two double sunshades of the invention can be connected to each other, by means of the zippers 42 connecting the canopy 4 of one double sunshade with that 4' of another double sunshade, forming a larger canopy to shade a larger area.

Figure 7:
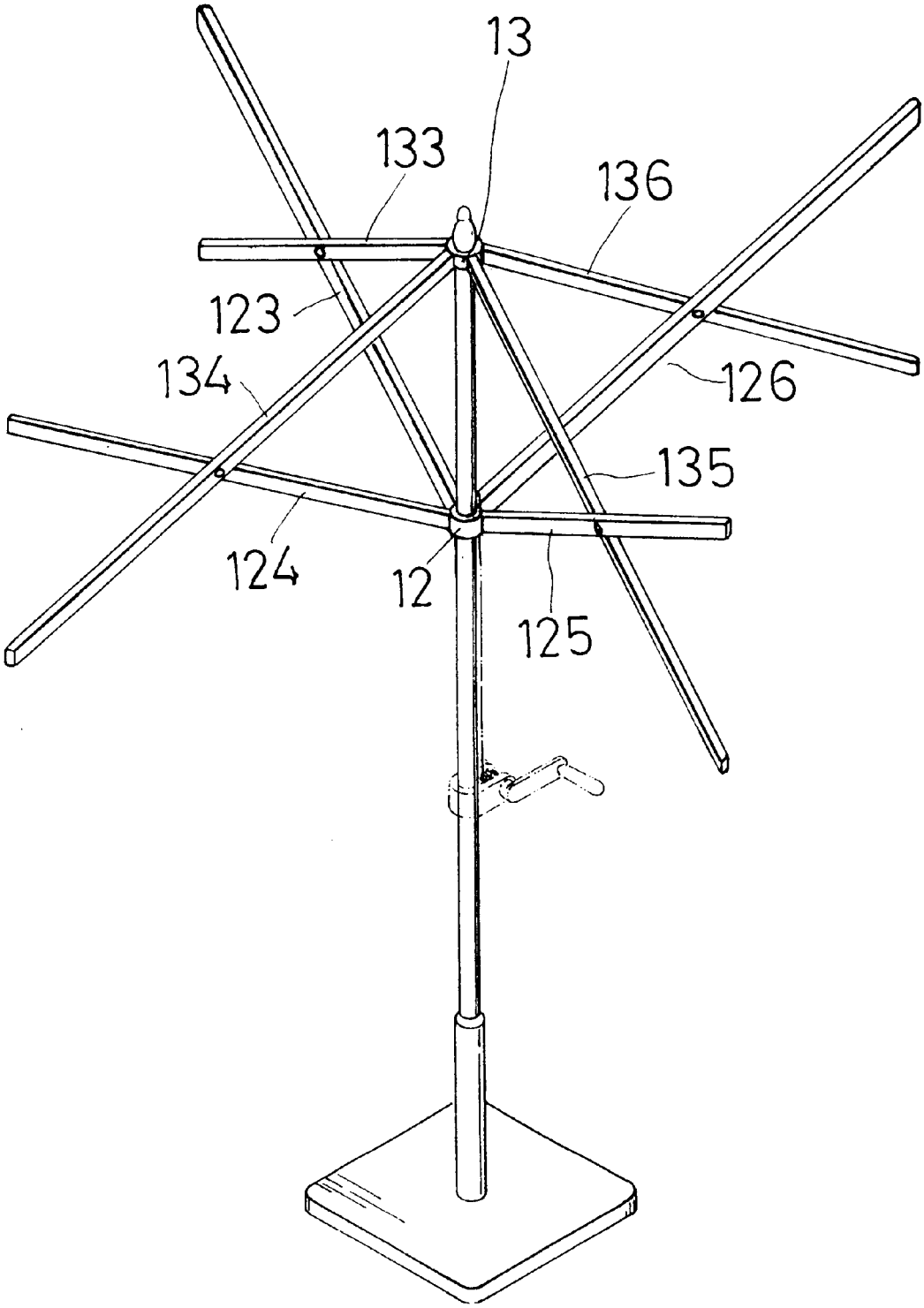
FIG. 7 is a perspective view of a main shank of a second embodiment of a double sunshade of the present invention; and, FIG. 8 is a perspective view of the second embodiment of a double sunshade of the present invention.
Figure 8:
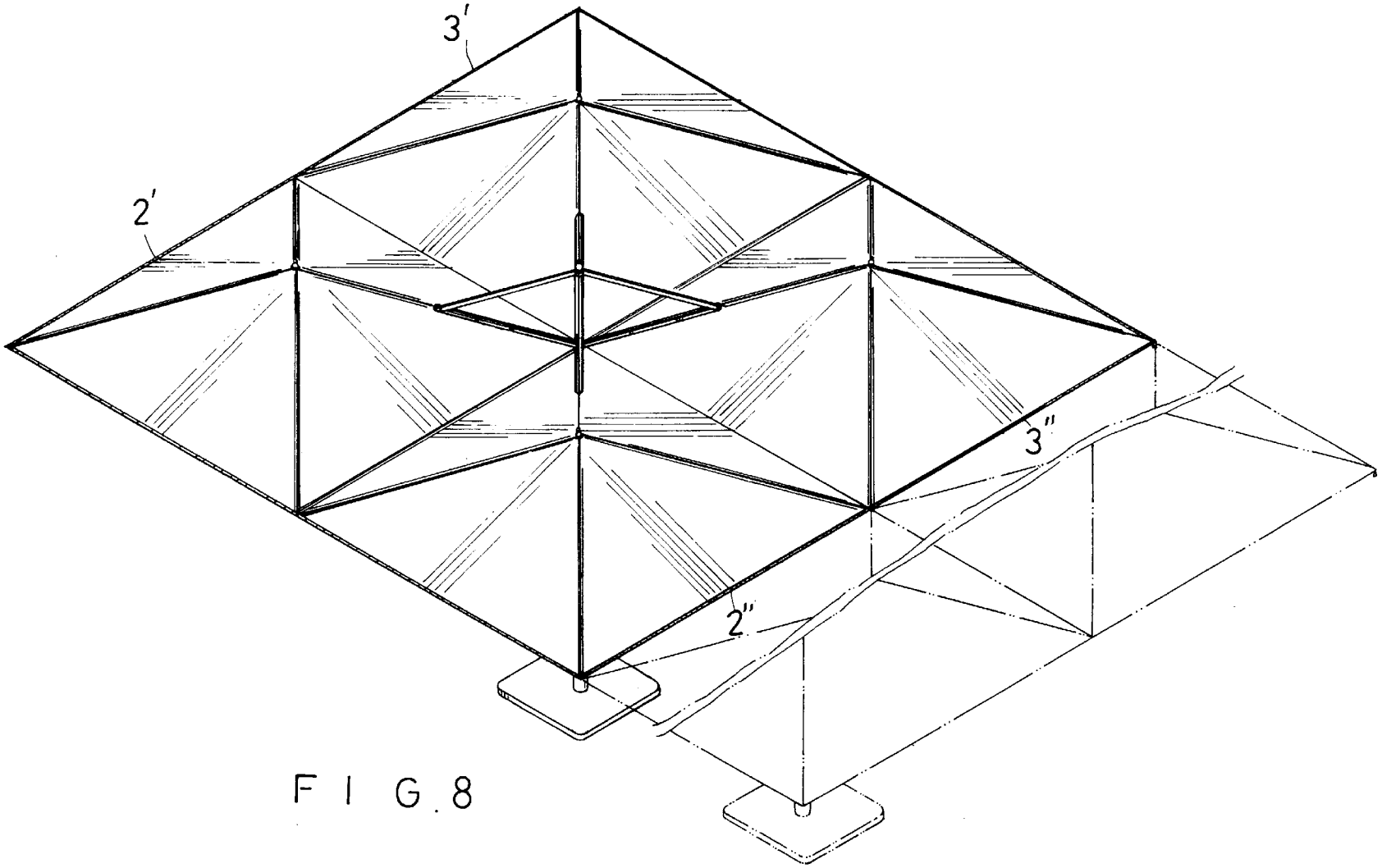

A second embodiment of a double sunshade of the present invention is shown in FIG. 7, further includes spreaders 123, 124, 125, 126 pivotally connected to the main runner 12 and ribs 133, 134, 135, 136 pivotally connected to the inside cap 13, added to the first embodiment. Then those spreaders and ribs are pivotally connected to subordinate inside caps and subordinate runners of four subordinate sunshades 2', 2", 3', 3". So when the main runner 12 of the main shank 1 is moved up to a highest point, the subordinate sunshades 2', 2", 3', 3" are also spread out, forming a two-double sunshade with a much larger dimensions, as shown in FIG. 8.

The double sunshade in the invention may be used independently to acquire a large shading dimensions, and also may be connected with another of the same double sunshade to get a much larger shading area of a neater appearance than many independent conventional sunshades look, usable in a leisure amusement park and able to attract customers to the site.

What is claimed is:

1. A double sunshade comprising a main shank, a left subordinate sunshade, a right subordinate sunshade, and a canopy combined together, said left and said right subordinate sunshades respectively having a plurality of ribs and spreaders to form a rib skeleton and a spreader skeleton;

said main shank having an inside cap fixed firmly on top, a main runner movably fitted thereon, a pair of main ribs connected pivotally to said main inside cap and extending on opposing sides thereof, a pair of main spreaders connected pivotally to said main runner and extending outward on opposing sides thereof, said main ribs and said main spreaders respectively crossing each other at a pivotal point, a portion of said spreader and said ribs extending outward from said pivotal point;

each of said left and said right subordinate sunshades comprising a subordinate shank, a subordinate inside cap, a subordinate runner, the outer end of each said main rib connected pivotally to each said subordinate inside cap, the inner end of each said main spreader connected pivotally to each said subordinate runner, said subordinate runner of said left and said right subordinate sunshades moved up and down to push or pull said spreader skeleton formed by said subordinate spreaders of said left and right subordinate sunshades when said main shank is moved up and down;

said canopy having a preset shape, an elongate opening formed in the center portion of said canopy such that the upper portion of said main shank and said main ribs to be extended upwardly; and, said subordinate runners of said left and said right subordinate sunshades moved up and down to a highest point to spread or collapse said left and said right subordinate sunshades when said main runner of said main shank is moved up to the highest point and down to the lowest point.

2. The double sunshade as claimed in claim 1, wherein a winder is further fixed on said main shank, a string wound around said winder and extending upwardly and tied on a ring attached on said main runner so that said main runner is movable upwardly and downwardly along said main shank.

3. The double sunshade as claimed in claim 1, wherein a hole is formed in an upper portion of said main shank, a tab fit in said hole and protruding outwardly to support said main runner when said main runner is moved up to a highest point for spreading said double sunshade.

4. The double sunshade as claimed in claim 1, wherein said canopy has its peripheral edge sewn with a zipper for connecting one of said double sunshade to another of said double sunshade.

5. The double sunshade as claimed in claim 1 wherein said canopy has its peripheral edge sewn with a Velcro band for connecting one of said double sunshade to another of said double sunshade.

* * * * *